US006079326A

United States Patent [19]

Strutz et al.

[11] Patent Number: 6,079,326

[45] Date of Patent: Jun. 27, 2000

[54] METHOD AND APPARATUS FOR USING WORKPIECE REGISTRATION TO INLINE DECORATE AND CURE WORKPIECES

[75] Inventors: Carl J. Strutz, Mars; John M. Zwigart, New Brighton; Mark R. Tweedy, Valencia; Gary W. McCoy, Butler, all of Pa.

[73] Assignee: Carl Strutz & Co., Inc., Mars, Pa.

[21] Appl. No.: 09/079,753

[22] Filed: May 15, 1998

[51] Int. Cl.[7] ..... B41F 17/08

[52] U.S. Cl. ..... 101/40; 101/37; 101/44

[58] Field of Search ..... 101/37, 40, 43, 101/44; 198/343.1, 467.1

[56] References Cited

U.S. PATENT DOCUMENTS

| | | | |
|---|---|---|---|
| 3,960,073 | 6/1976 | Rush | 101/40 |
| 5,317,967 | 6/1994 | Heidenreich | 101/38.1 |
| 5,471,924 | 12/1995 | Helling | 101/38.1 |
| 5,524,535 | 6/1996 | Strutz et al. | 101/38.1 |
| 5,651,308 | 7/1997 | Rohwetter et al. | 101/40.1 |
| 5,711,216 | 1/1998 | Tiemann et al. | 101/40.1 |

*Primary Examiner*—John S. Hilten
*Assistant Examiner*—Daniel J. Colilla
*Attorney, Agent, or Firm*—Clifford A. Poff

[57] ABSTRACT

Ink decoration applied to bottles during a dwell period at decoration stations of an intermittent motion decorating machine is cured during a dwell period while the bottles dwell at curing stations, each downstream of a decorating station. A bottle rotator at each curing station is joined by a tie rod to drive a bottle rotator at a decorating station. An alternative embodiment provides separate drive motors for a decorating and a curing station and control of the motors is provided by the same control signal to rotate bottles during a dwell period. Restraint rails and rotators at all decoration and curing stations prevent loss of an established orientation between each bottle and each decoration screen at each decorating station. The established orientation can be established by an indexer at the bottle receiving end of the decorating machine.

24 Claims, 15 Drawing Sheets

METHOD AND APPARATUS FOR USING WORKPIECE REGISTRATION TO INLINE DECORATE AND CURE WORKPIECES

BACKGROUND OF THE INVENTION

1. Field of the Invention

The present invention relates to improvements to an intermittent motion type decorating machine for decoration of workpieces and, more particularly, to improving the method and apparatus for decorating workpieces in such a decorating machine by providing that while workpieces are decorated at each of a plurality of decorating stations, the ink decoration applied at one of the decorating stations is cured before the workpiece is discharged from the decorating machine.

2. Description of the Prior Art

As shown in U.S. Pat. Nos. 2,231,535; 2,261,255; 2,721,516; and 3,146,705 intermittent motion type decorating machines are known in the art and provide a drive system to impart intermittent traveling motion to the workpieces such as containers made of glass or plastic. A container is moved through a predetermined distance, stopped, moved again through a predetermined distance, stopped and again moved until each container through the sequence of motions moves completely through the decorating stations of the machine. A decorating station will be provided at one or more places where the container comes to a stop. At each decorating station, a decorating screen is displaced into line contact with the surface of the container by an associate squeegee. During the decorating process a synchronous speed relation is maintained at line contact established by the squeegee between the screen undergoing linear displacement and the container undergoing rotation. The squeegee remains stationary during the decorating process. Decorating machines of this type are particularly useful to decorate bottles and carryout the decoration while the surface of the bottle to be decorated is horizontally orientated. In the aforesaid U.S. Pat. No. 2,261,255 there is disclosed a drive for moving each of a screen to decorate a cylindrical body of a bottle and a shoulder screen to decorate a tapered neck portion of the bottle substantially at the same peripheral linear speed. The decorating machine disclosed in the aforesaid patent number 3,251,298, provided a production rate of about 125 bottles per minute. More recently as disclosed in U.S. Pat. No. 5,524,535 a decorating machine design is provided to increase the production rate of up to 150 bottles per minute.

In such intermittent motion decorating machines, thermosetting ink was used as a printing medium particularly when multiple color decoration was desired. Ink of only one color is applied at each decorating station and to decorate with multiple colors requires corresponding multiple decoration stations. Because the different colors interleave in a given area of the bottle such an area is contacted with the screens for each color, it is necessary that the ink/color is a solid and will not smear. Although the ink is solidified after each printing operation, it was necessary to cure the ink by feeding the bottles through a furnace after discharging from the decorating machine. The curing of the ink in this way represents an added cost to the printing process in terms of the cost of energy and floor space. Also, the required handling of the bottles was a loss factor because of breakage. The present invention seeks to provide a decorating method and apparatus to allow curing of ink decoration applied at one station before additional decoration is applied so that a bottle delivered from a decoration machine can be loaded directly into shipping containers without the need for curing the ink decoration.

The present invention provides a method and apparatus to use a decorating medium which will cure very rapidly when exposed to a source of an electromagnetic wave such as ultraviolet radiation or heat in intermittent motion type decorating machines discussed hereinbefore, more particularly the present invention provides curing stations which can be interleaved between printing stations and provide drives to rotate the workpiece at the curing station for exposing uncured printing medium to the electromagnetic wave or heat to curing the printing medium. In this way, the workpiece can immediately receive decorating medium applied over the same area containing the cured decorating medium and without the loss of a preestablished orientation such as bottle seam registration.

SUMMARY OF THE PRESENT INVENTION

According to the present invention there is provided a method for decorating workpieces including the steps of engaging opposite ends of successive ones of a plurality of workpieces for rotatable support about a longitudinal axis of each workpiece, intermittently advancing each of the workpieces with respect to decorating screens while maintaining a predetermined orientation with respect to the longitudinal axis of the workpieces at a plurality of spaced apart decorating stations, decorating workpieces at each of the spaced apart decorating stations by displacing an ink laden decorating screen along a path of travel between a squeegee and a workpiece, advancing each workpiece after decorating at least at one of the decorating stations to at least a first curing station, and curing the ink decoration applied to a workpiece at the first curing station, the step of decorating workpieces and the step curing the ink decoration occurring while rotating the workpiece and maintaining said predetermined orientation.

The present invention farther provides an apparatus for decorating workpieces including the combination of a conveyor having successive workpiece support sites each including spaced apart chucks for supporting a workpiece to rotate about a longitudinal axis of the workpiece, a plurality of decorating stations arranged at spaced apart locations along the conveyor, the decorating stations each including a decorating screen to apply a curable printing medium while reciprocated between a squeegee and a workpiece at the printing station, at least one curing station supported along said conveyor downstream of one of the decorating stations, the curing station including a generator for emitting a medium toward a workpiece to cure the applied printing medium thereon, restraints for maintaining a predetermined orientation of each workpiece with respect to the decorating screens at the decorating stations while supported by the chucks, a first drive coupled to the conveyor for intermittently advancing spaced apart workpieces along a course of travel containing the decorating stations and the ink curing station, the first drive indexing each workpiece between a dwell period at each of the decorating stations and the ink curing station, second drives to rotate workpieces while dwelling at the decorating stations, and a third drive to rotate a workpiece at the ink curing station in response to dwelling of a workpiece at the ink curing station.

BRIEF DESCRIPTION OF THE DRAWINGS

The present invention will be more fully understood when the following description is read in light of the accompanying drawings in which.

DETAILED DESCRIPTION OF THE PREFERRED EMBODIMENTS

Figure 1:
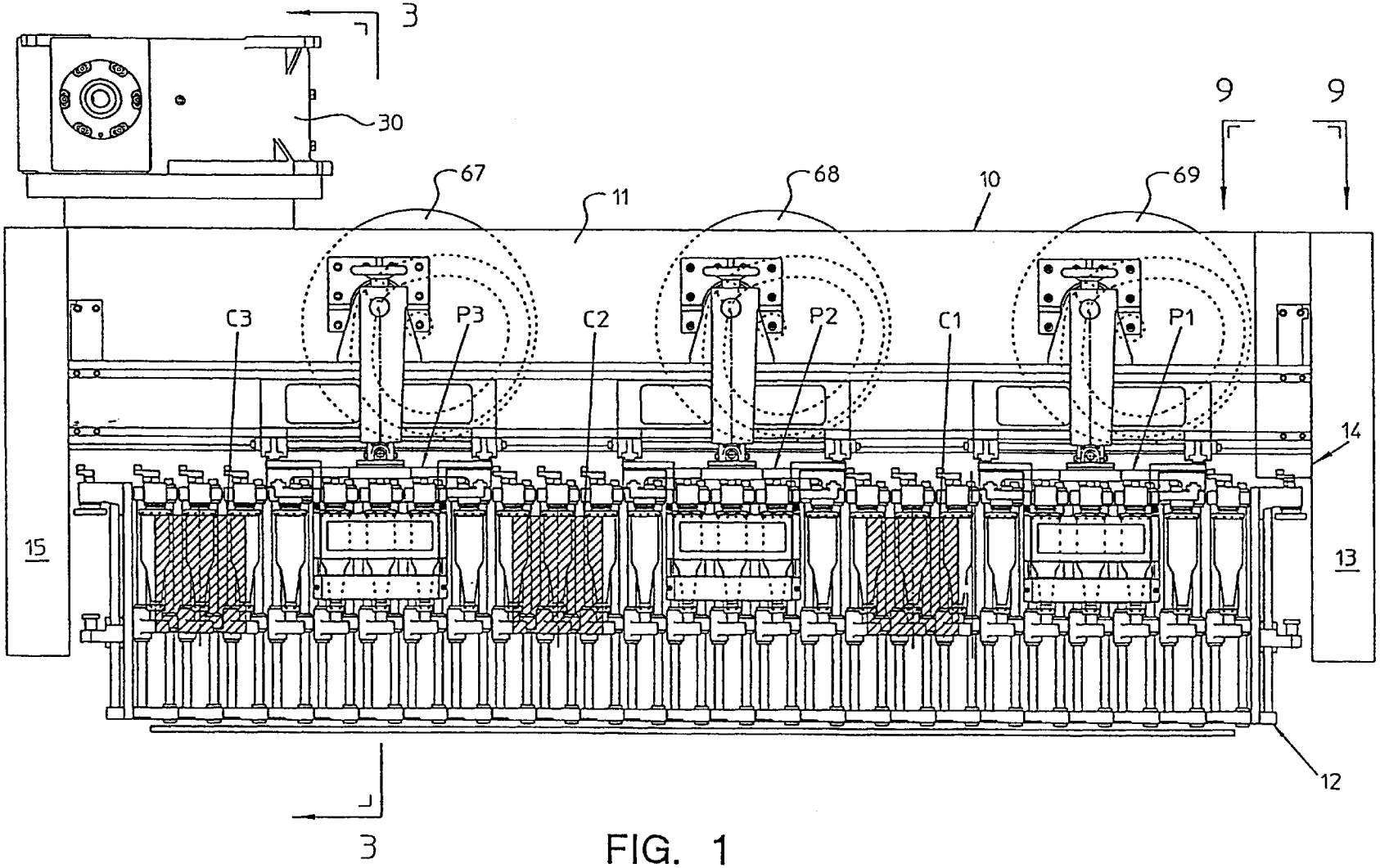
FIG. 1 is a plan view of a decorating machine according to a preferred embodiment of the present invention.

Referring now to FIGS. 1–6 of the drawings, there is illustrated a decorating machine 10 according to a preferred embodiment of the present invention which comprises a base 11 for supporting an endless chain conveyor 12 to convey workpieces which, for the purpose of describing the preferred embodiment of the present invention, consist of bottles. The conveyor receives bottles from bottle loading equipment 13 and advances the bottles by intermittent motion to a registration station 14 and thence to three successively arranged decorating stations P1, P2 and P3. According to the present invention between decorating stations P1 and P2 there is located a curing station C1, between decorating stations P2 and P3 there is located a curing station C2 and after decorating station P3 there is curing station C3. Curing in this manner avoids smearing of ink decoration applied at each of the stations P1, P2 and P3 particularly when multi-color decoration is applied to the same area of the bottle. The curing process is carried out by exposing the freshly applied decoration curable by an energy source such as ultraviolet, infrared or heat. It is to be understood that the number of ink curing stations and decorating stations will be chosen to satisfy a particular need. It is within the scope of the present invention to provide more than three or less than three of each such stations, it being necessary to provide an ink curing station downstream of at least one decorating station so that ink decoration in at least one area on a bottle is cured in the operation of the printing machine. The bottles are advanced from the last curing station C3 to bottle unloading equipment 15. The bottle loading and unloading equipment 13 and 15 are per se well known in the art and may be constructed in the manner disclosed in U.S. Pat. No. 5,524,535 and such disclosure is incorporated herein by this reference thereto.

Figure 2:
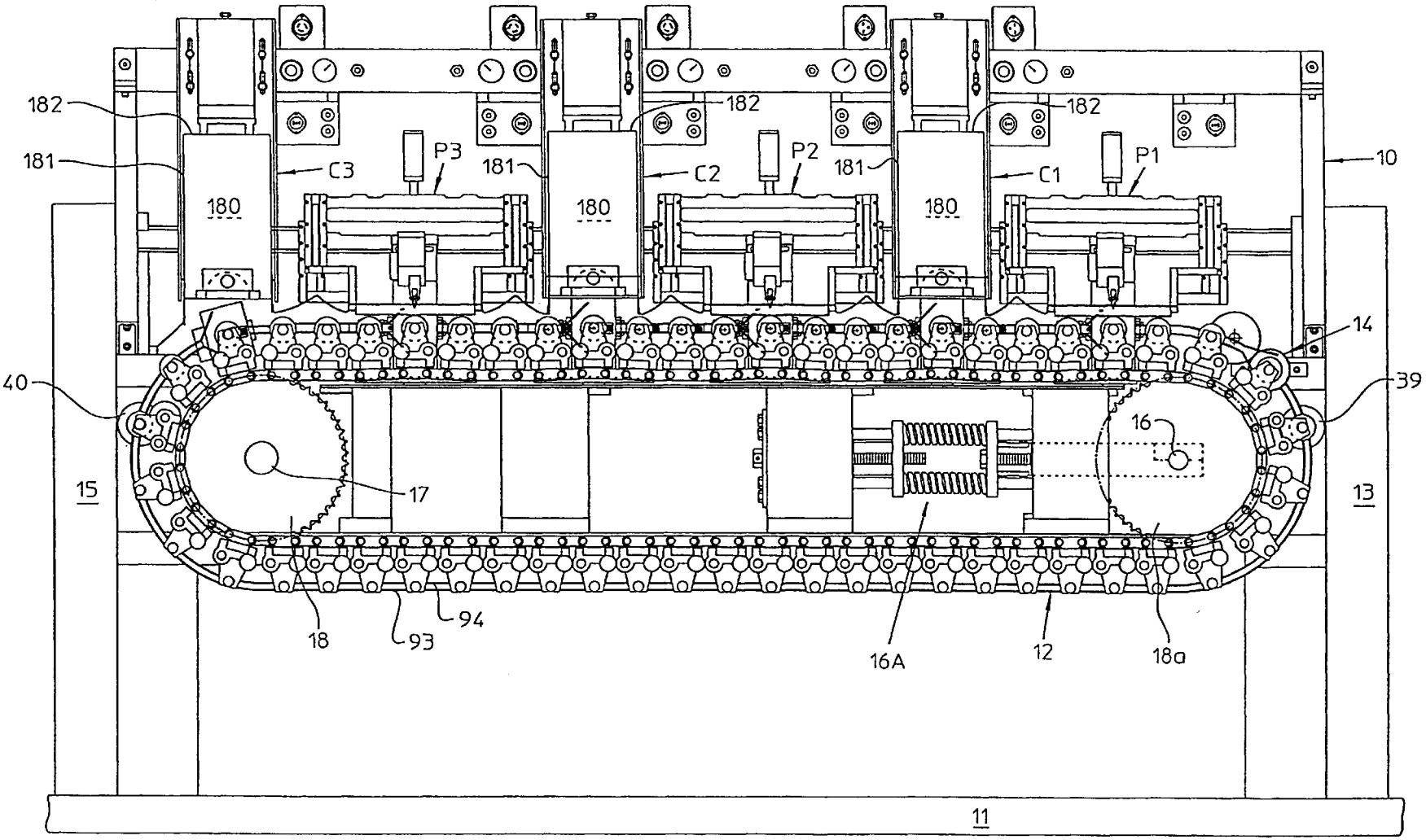
FIG. 2 is a front elevational view of the decorating machine shown in FIG. 1.
Figure 3:
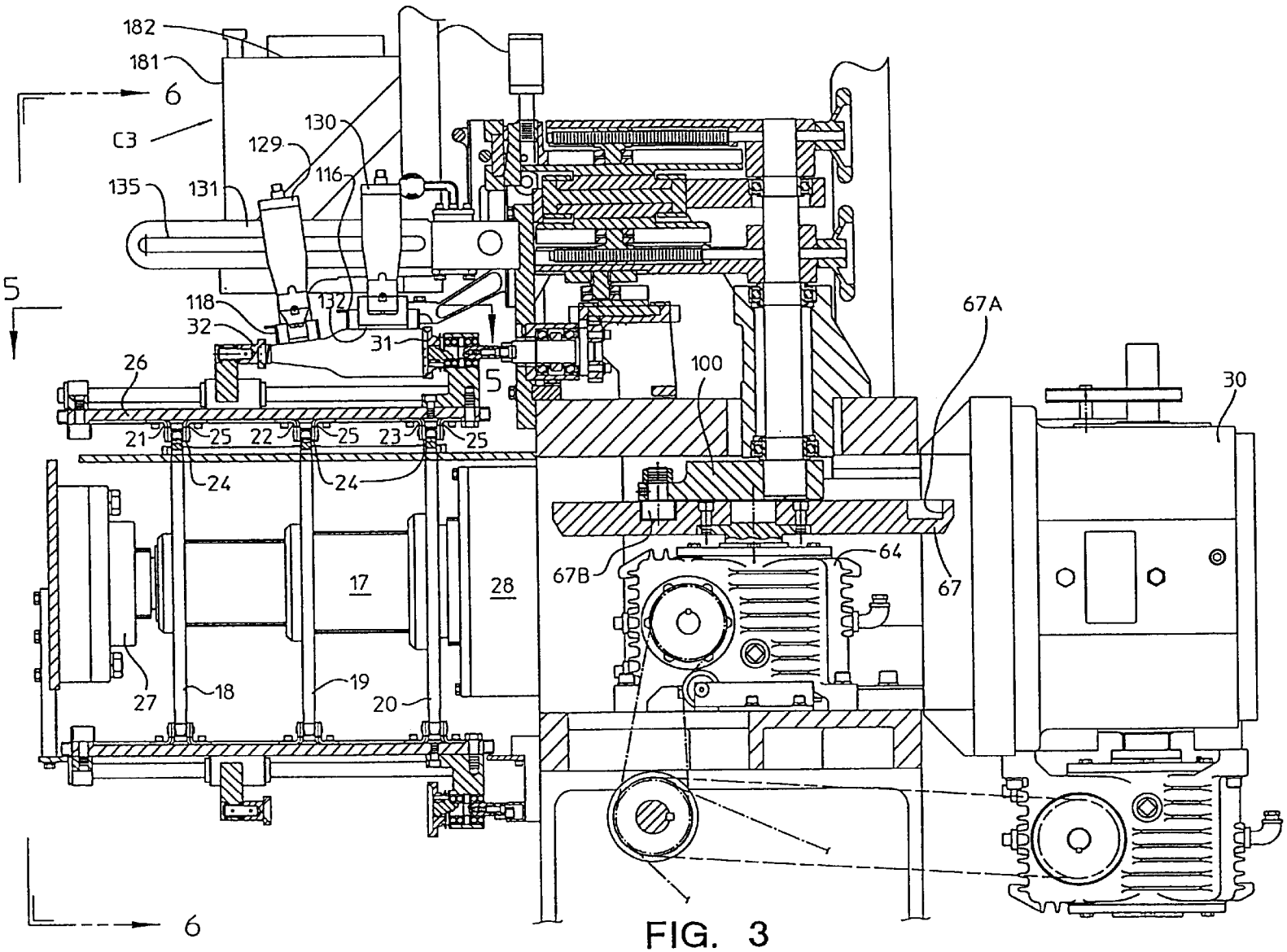
FIG. 3 is a sectional view taken along lines 3—3 FIG. 1.
Figure 4:
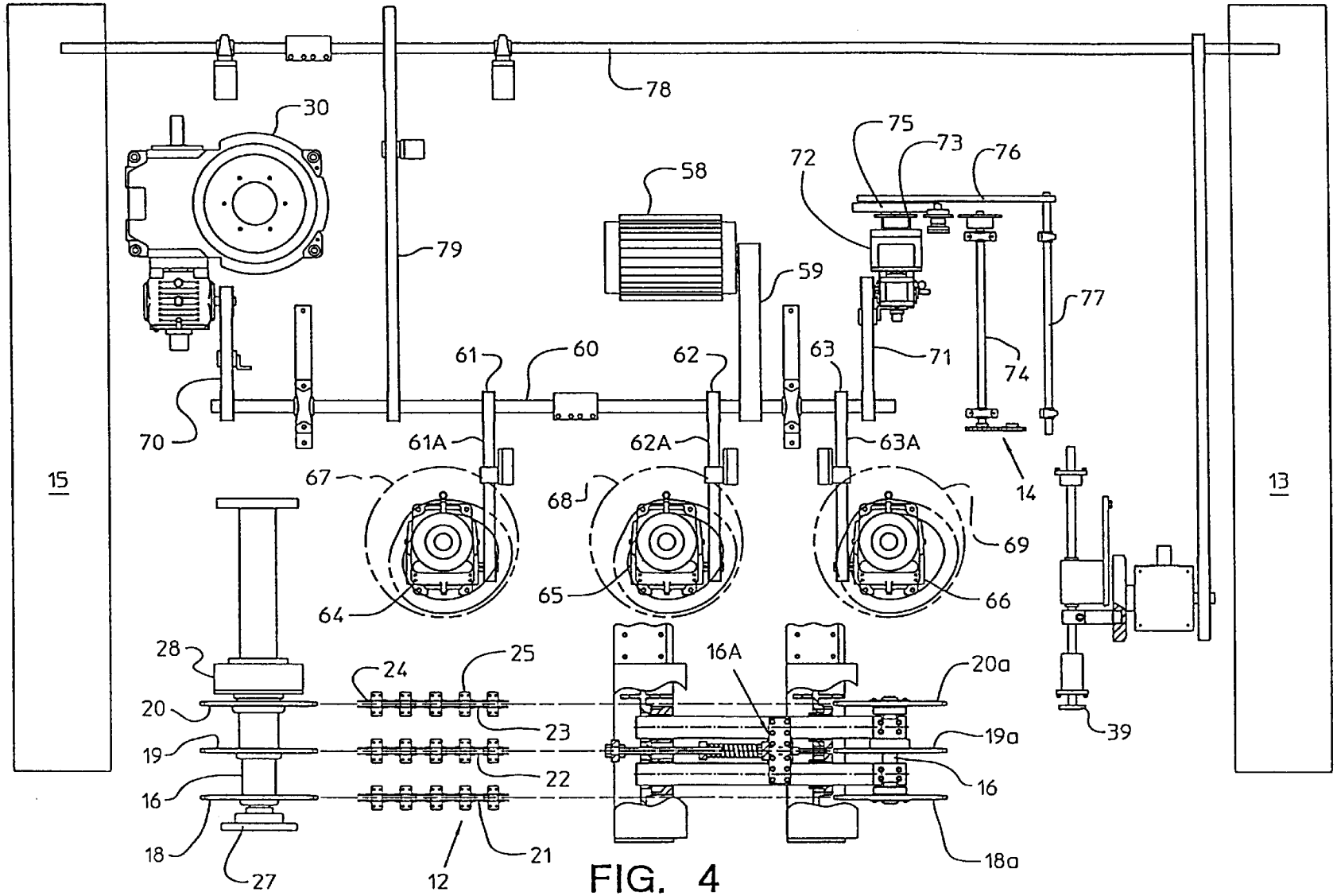
FIG. 4 is a schematic drive layout illustrating the major drive components comprising the decorating machine of FIG. 1.

As shown in FIGS. 2–4, the conveyor 12 includes a support shaft 16 at the entry end of the conveyor and a drive shaft 17 at the delivery end of the conveyor. Support shaft 16 is supported by a spring tensioning assembly 16A carried by the base 11 to maintain a preselected tension applied by assembly 16A to the sprockets 18A, 19A and 20A and then to the endless chains 21, 22 and 23. Drive shaft 17 is drivenly engaged with co-axially aligned and spaced apart drive sprockets 18, 19 and 20 to drive the runs of endless chains 21, 22 and 23. Links 24 of each endless chain are interconnected by one of three lugs 25 protruding from the bottom of each of a plurality of carrier plates 26. The drive shaft 17 is rotatably supported by an outboard bearing support 27 mounted on a sidewall of base 11 and at the inboard side, the drive shaft 17 is supported by an inboard bearing support 28 mounted on a part of the base 11. Drive shaft 17 has an extended shaft portion extending beyond the inboard bearing support 28 to a drive output member of a conveyor index box 30. The index box imparts intermittent advancing motion to the conveyor 12 while the bottles are supported in a horizontal orientation between a base cup 31 and a mouthpiece 32.

Figure 5:
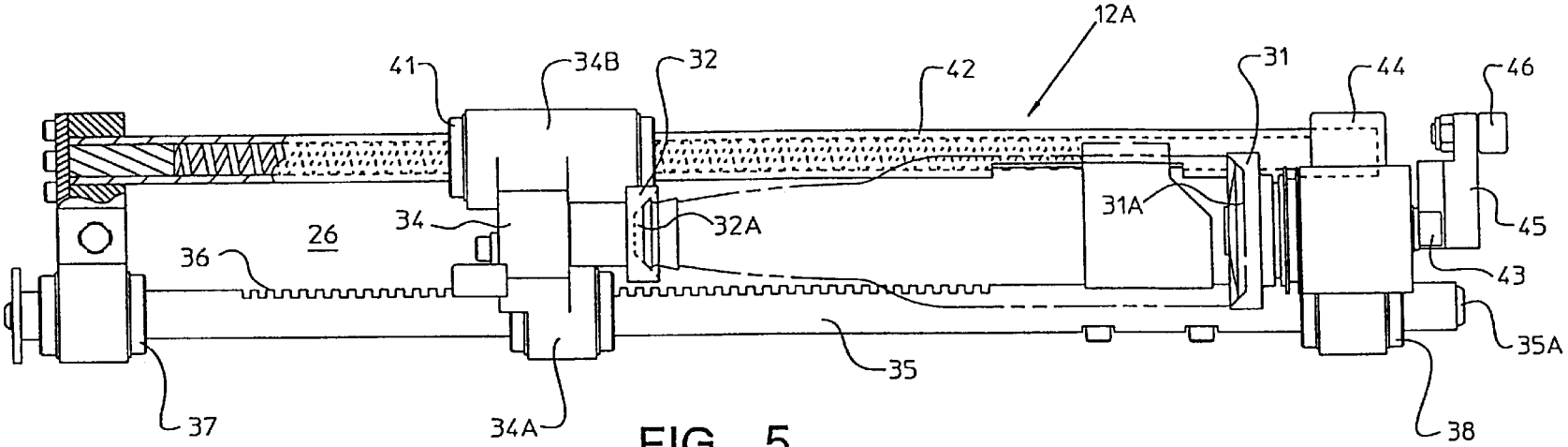
FIG. 5 is a plan view taken along lines 5—5 of FIG. 3.
Figure 7:
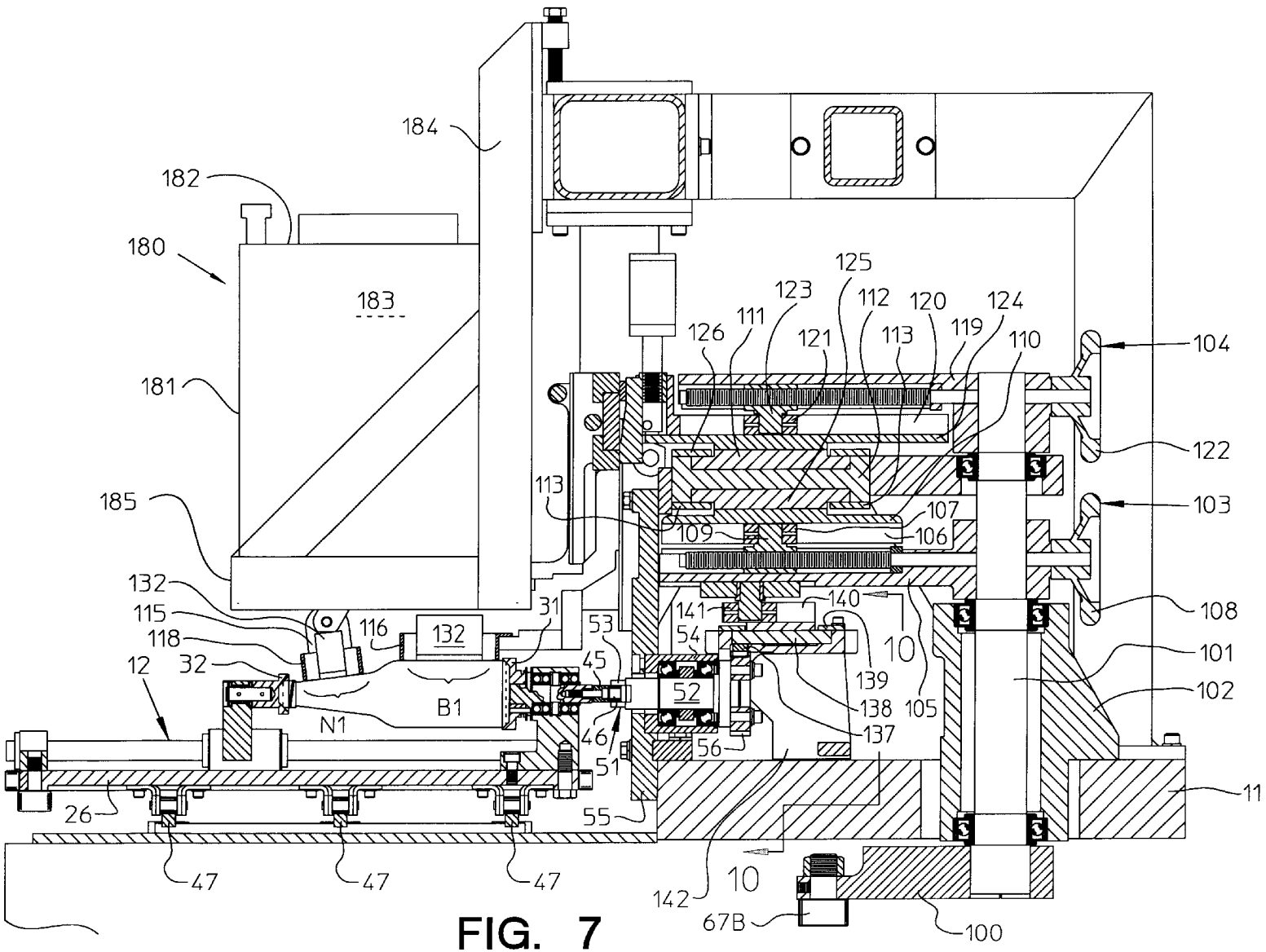
FIG. 7 is an enlarged fragmentary part of the sectional view of FIG. 3

As shown in FIGS. 5 and 7, base cup 31 has a shallow support surface 31A surrounded by a protruding beveled edge to receive and center the base section of the bottle. Mouthpiece 32 has a shallow support surface 32A surrounded by a protruding beveled edge to receive and center the mouth of the bottle. Mouthpiece 32 is rotatably supported by neck chuck 34 having diverging support legs 34A and 34B. Leg 34A is selectively positionable along an actuating shaft 35 having teeth 36 for engaging a releasable latch to allow clamped positioning of the mouthpiece 32 relative to the base cup 31 at any of diverse sites to accommodate a particular height of a bottle between the base cup and mouthpiece. The actuating shaft 35 is slidably supported by spaced apart linear bearings 37 and 38 mounted on carrier plate 26. An end portion 35A of shaft 35 protrudes from the bearing adjacent the base cup 31 for contact with a clamping actuator device 39 located at the bottle entry site (FIG. 2) where the bottle is received by the conveyor 12 and a clamping actuator device 40 located at the bottle discharge site where the bottle is released from the conveyor. As shown in FIGS. 5 and 7, leg 34B of the neck chuck is provided with a linear bearing support block 41 resiliently supported by a support shaft 42 in the same manner as disclosed in U.S. Pat. No. 3,338,574 whose disclosure is incorporated herein by this reference thereto.

Figure 6:
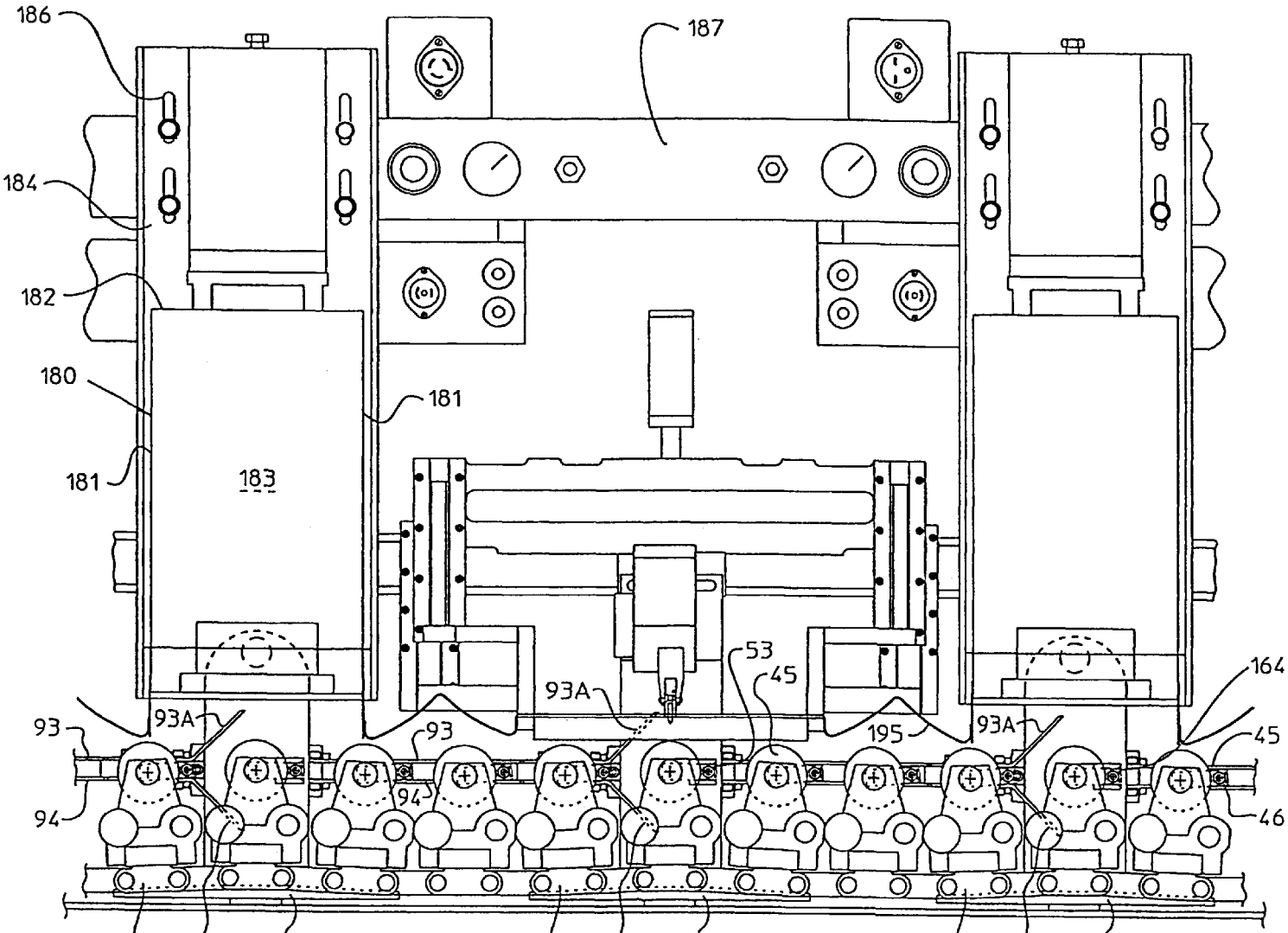
FIG. 6 is an enlarged front elevational view taken along lines 6—6 of FIG. 3.

As shown in FIG. 5, extending from the base cup 31 is a journal 43 which is rotatably supported by a bearing in an upstanding housing 44. An end part of the journal is bolted to a crank arm 45 extending perpendicular to the rotational axis of journal 43. The free end of arm 45 supports a drive roller 46 for rotating the base cup at the registration station 14 and a bottle at each of the decorating and curing stations. As will be described in greater detail hereinafter, the crank arm 45 and its drive roller 46 also serve to control the position of the bottle while advanced to and from the decorating stations and curing stations by conveyor 12. As best shown in FIGS. 6 and 7, at each decorating station the chain links of the conveyor ride along bottle riser cams 47 which elevate the bottle a short distance so that the decorating screens can freely reciprocate in either direction without impingement contact with adjacent bottles.

At each decorating station P1, P2 and P3 there is arranged a rotator assembly 51 embodying a construction of parts as best shown in FIGS. 6 and 7. The rotator assembly includes a rotator arbor 52 having an end portion formed with a slotted opening 53 into which the drive roller 46 can pass into a driven relationship with crank arm 45 for rotating the bottle 360° for a bottle decorating operation. Arbor 52 is supported for rotation by a bearing in a housing 54 that is in turn secured to a face plate 55 forming part of the base 11 of the decorating machine. The arbor 52 has a portion extending from the bearing housing and to which there is mounted a drive gear 56. As will be explained in greater detail hereinafter, the drive gear 56 is driven by bottle rotating drives at each of the decorating stations. As a bottle carrier approaches each of the decorating stations, the crank arm 45 trails in the direction of conveyor movement so that the drive roller 46 passes into the slotted opening 53 to establish a universal type of drive relation with the rotor arbor 52.

Figure 9:
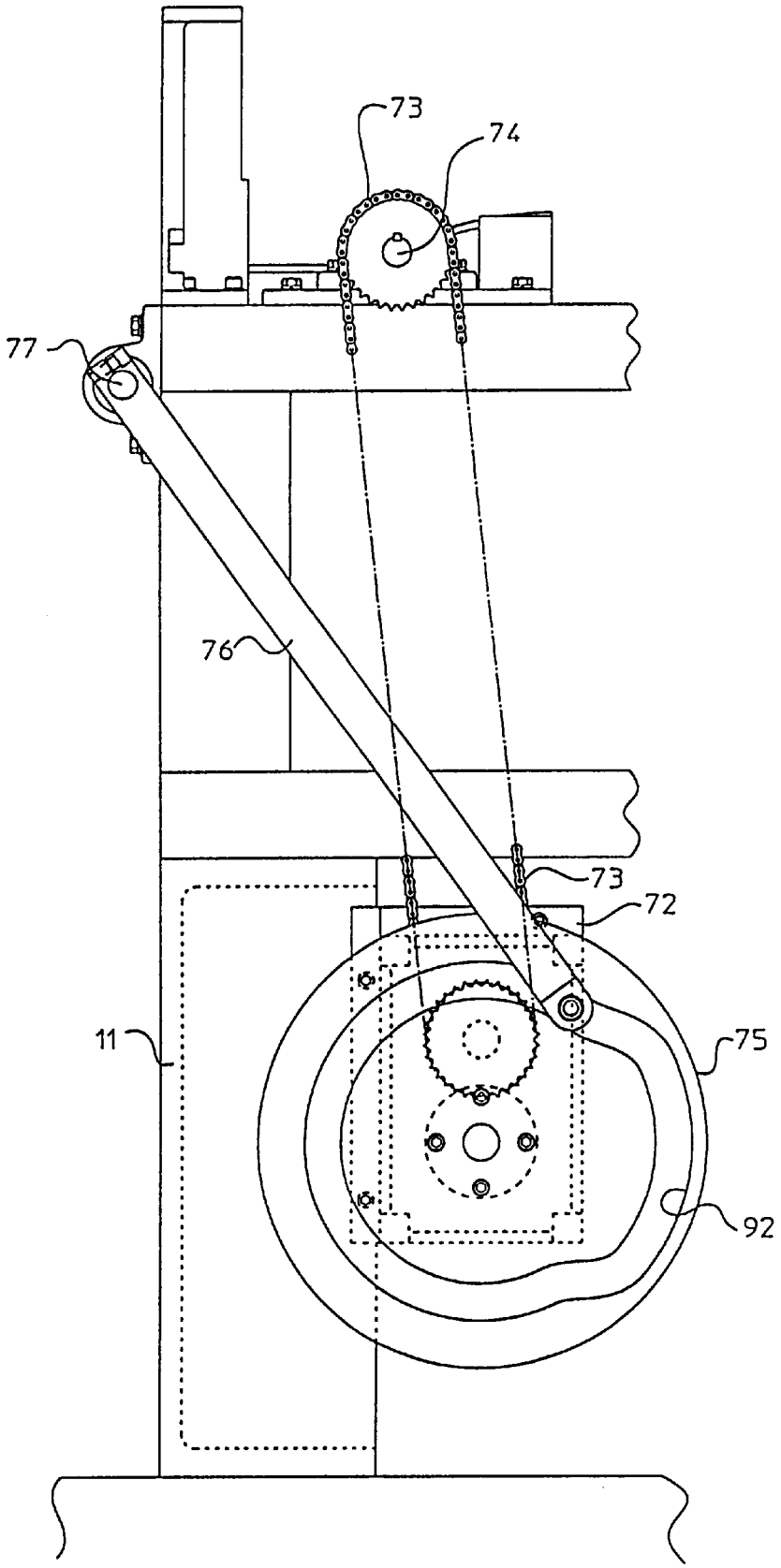
FIG. 9 is an elevation view taken along lines 9—9 of FIG. 1.

The drive arrangement for the decorating machine includes, as shown in FIGS. 3 and 4, a main drive motor 58 having a drive output shaft connected by a belt 59 to a first line shaft 60. Spaced along line shaft 60 are three pulleys 61, 62 and 63 provided with belts 61A, 62A and 63A extending to gear drives 64, 65 and 66, respectively. The gear drives have output shafts secured to rotate closed cams 67, 68 and 69. A closed cam is also known as a face groove or positive cam. Each cam has a follower in the respective cam slot to pivot an oscillating drive output. The first line shaft 60 is also provided with a pulley connected by a belt 70 to a drive input shaft of the conveyor index box 30. A further belt 71 connects a pulley mounted on line shaft 60 to an index drive 72. As shown in FIGS. 4 and 9, the index drive 72 has an output shaft on which is mounted one of meshing drive gears to drive a sprocket carried by idler shaft for a chain 73 to drive a registration drive shaft 74. Also mounted on the drive output of index drive 72 is a cam 75 connected by a drive arm 76, to be described in greater detail hereinafter, to oscillate a shaft 77 for a registration head. The first line shaft 60 is drivenly coupled to a second line shaft 78 by belt 79 trained between pulleys mounted on the line shafts. Line shaft 78 has spaced apart pulleys connected by belts, not shown, to drive the bottle loading equipment 13 and bottle unloading equipment 15.

Figure 8:
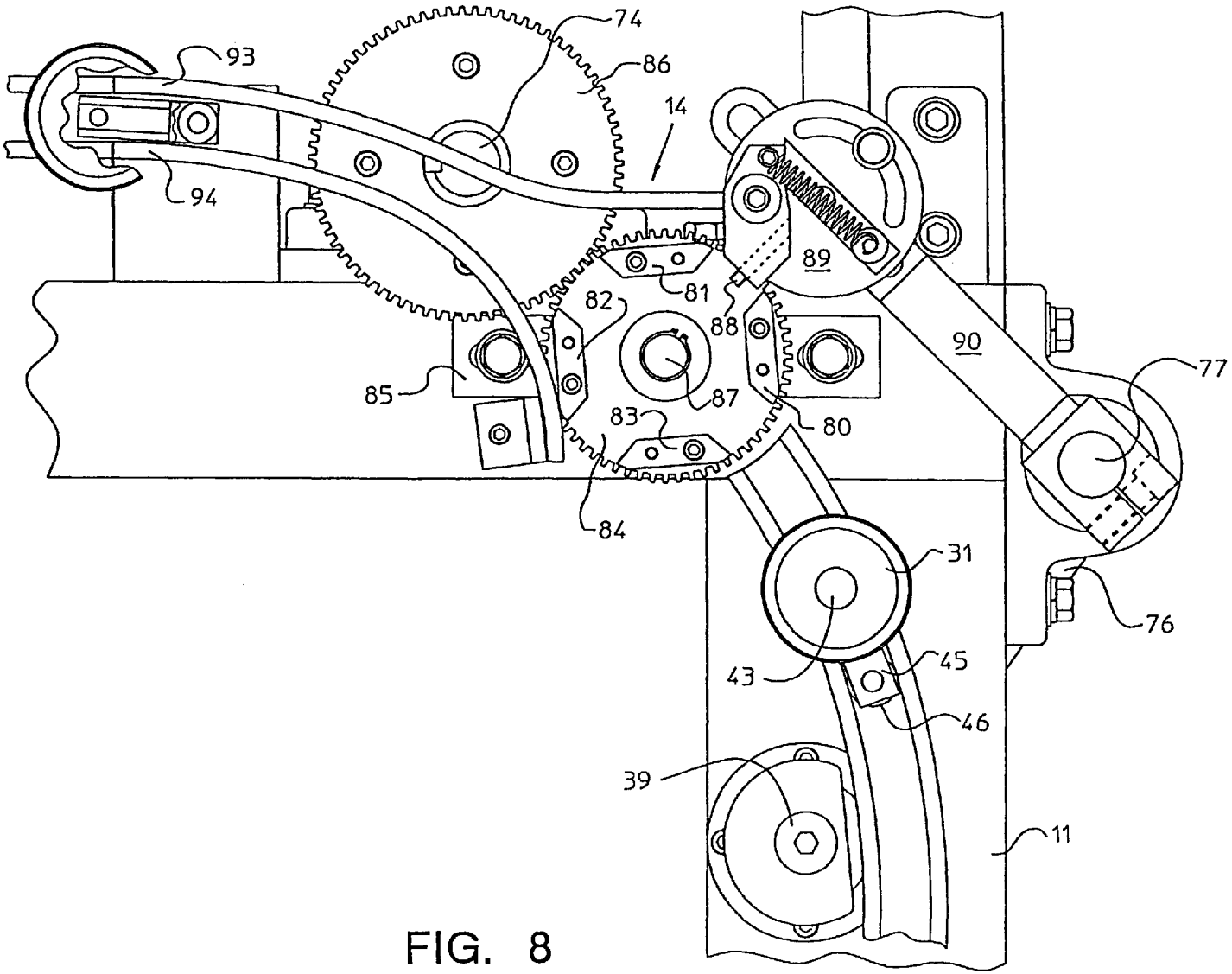
FIG. 8 is an enlarged elevation view of the registration station at the entry side of the conveyor for the decorating machine of the present invention.

As shown in FIGS. 5, 8 and 9, as the bottles are supplied to the decorating machine, the bottles are initially arranged horizontally and engaged between base cup 31 and neck chuck 34 and thence advanced intermittently to the registration station 14. As the bottles arrive at the registration station, the drive roller 46 on the end of the crank arm 45 passes into one of four peripherally spaced openings between drive blocks 80, 81, 82 and 83 on a face of a gear 84 which is rotatably supported by a bearing in a bearing housing 85 that is turn secured to a frame forming part of the base 11. The gear 84 has gear teeth that mesh with gear teeth of a gear 86 mounted on an end portion of registration drive shaft 74 which as previously described, is driven by a chain drive arrangement shown in FIG. 9 connected to an index drive 72. The bottle is rotated about its longitudinal axis by the bottle rotating drive gear 84 that rotates about a drive axis 87. A registration finger 88 is pivotally mounted on a finger mounting plate 89 at a predetermined location along a slotted end portion of a registration arm 90 so that the registration finger 88 extends into the path of travel of a registration cavity formed in the lower base portion of the bottle. The registration arm 90 is secured to the drive shaft 77 supported by bearings and driven by a pivot arm 76 as shown in FIG. 9 in response to oscillations produced by a follower in a closed cam track 92 also known as a face groove or positive cam driven by a drive output shaft of index drive 72. The motion imparted to the registration arm 90 moves the registration finger into its operative position so that when the registration finger passes into the registration cavity of the bottle, rotation of the bottle is stopped thereby, and slippage occurs between the bottle base and the base cup 31 as the cup continues to rotate to completion of the bottle registration cycle. When bottle rotation is stopped there is established a predetermined bottle orientation with respect to the decorating screens because the screens are also stationary at this time and thereafter bottle rotation and screen movement are synchronous.

The predetermined bottle orientation establishes a predetermined registration of the workpiece with respect to the decorating screens at each of the spaced apart decorating stations and as will be explained in greater detail hereinafter, the predetermined registration is maintained as each bottle is rotated for curing as shown in FIGS. 1 and 2 at the curing stations C1, C2 and C3. The registration process is particularly useful to orientate seam lines extending along opposite sides of a bottle with respect to the location of the desired area for decoration. As shown in FIG. 8, registration of the bottle is concluded with the orientation of the crank arm 45 such that the drive roller 46 trails the advancing movement of the bottle carrier in an intermittent fashion to the decorating stations. As the drive roller 46 emerges from a slot between the drive blocks 80–83, the roller is captured and guided by spaced apart guide rails 93 and 94. These guide rails extend along the course of travel by the drive roller 46 throughout the indexing movement by the conveyor to thereby maintain registration of the bottle at each decorating station and at each curing station. As shown in FIGS. 2 and 6, the guide rails 93 and 94 form an endless path to capture the roller and guide the crank arms. However, at each of the decorating stations P1, P2 and P3 and at each of the curing stations C1, C2 and C3 the continuity of the guide rails 93 and 94 are interrupted by a gap wherein a drive member is located to receive and rotate the bottle. As best shown in FIG. 6, downstream of each gap are outwardly protruding collector rail portions 93A and 94A that return the roller and crank arm to the gap between guide rails 93 and 94 when the conveyor operates to advance bottles after completion of the decorating and curing cycles.

At each decorating station P1, P2 and P3 the arrangement of apparatus is identical. As shown in FIGS. 3, 4 and 7, it can be seen that the gear drive 64 has its output drive shaft connected to rotate the cam 67. A cam track 67A is machined into the closed cam 67 and received in the cam track is a cam follower 67B. The cam follower is mounted to a lever arm 100 which is in turn secured to the lower end of a vertical shaft 101. The shaft 101 is supported by spaced apart bearings, as shown in FIG. 7, which are in turn carried by a tubular column 102 supported by the base of the decorator machine 11. At the top of the column 102 there are superimposed oscillation arm assemblies 103 and 104. Assembly 103 is made up of a lever arm 105 secured to shaft 101 and provided with a guideway 106 extending radially of the shaft. In the guideway there is arranged a drive bar 107 which can be moved along the guideway by the threaded portion of a hand wheel 108. The distance the drive bar 107 is located radially of the rotational axis of shaft 101 is controlled by the hand wheel 108. A drive block 109 is mounted on a portion of the drive bar 107 projecting vertically above the guideway and reciprocates in an inverted "U" shaped slot formed in a drive bar 110. The drive bar is joined to a slide 111 supported in a guideway 112. The slide is held in a slot of guideway 112 by gib plates 113. While not shown, the slide 111 protrudes laterally from opposite sides of the tubular column 102 and is provided with outwardly spaced apart receiver arms 114 and 115. The receiver arm 114 engages a decorating screen assembly 116 that is reciprocated by the linear motion of the slide 111 to thereby reciprocate the decorating screen assembly along the body portion B1 of a bottle for carrying out decorating operations thereon. Assembly 104 includes a lever arm 119 secured to shaft 101 and provided with a guideway 120 extending radially of the shaft. In the guideway there is arranged a drive bar 121 which can be moved along the guideway by the threaded portion of a feed screw operated by a hand wheel 122. The distance the drive bar 121 is located radially of the rotational axis of shaft 101 is controlled by the hand wheel 122. A drive block 123 is mounted on a portion of the drive bar 121 projecting vertically downwardly from the guideway and reciprocates in a "U" shaped slot formed in a drive bar 124 The drive bar is joined to a slide 125 supported in a guideway 112. The slide 125 is held in a slot of guideway 112 by gib plates 126. The slide 125 protrudes laterally from opposite sides of the tubular column 102, in the same manner as slide 111 protrudes. Similarly, the receiver arm 115 engages a decorating screen assembly 118 that is reciprocated by the linear motion of the slide 125 to thereby reciprocate the decorating screen assembly along the neck portion N1 of a bottle for carrying out decorating operations thereon.

Hand wheels 108 and 122 are used to select a desired stroke for the screen reciprocation to match the circumferential distance of the bottle which is to be decorated. This matching relationship is critically significant because no relative motion between the screen movement and the bottle rotation can be accepted otherwise, smearing or poor quality decorating will occur. As shown in FIG. 3, squeegees 129 and 130 are carried by a support arm 131 in position above the screens 116 and 118, respectively. The squeegee construction is per se is known in the art and is shown in U.S. Pat. No. 3,172,357. Each squeegee includes a squeegee rubber 132 on the end portion of squeegee positioning cylinder operated pneumatically against the force of a return spring thereby to establish line contact between the screen assembly 116 and 118 and a bottle as the bottle is rotated in a synchronous speed with linear movement of the screens. The squeegees are adjustably located by fasteners engaged in a mounting slot 135 extending along the elongated length of the support arm 131.

At each decorating station there is provided as part of the screen drives, a drive to rotate the rotator assembly 51. As described previously and shown in FIG. 7 the rotator assembly includes a gear 56 which is located beneath lower arm 105 where the teeth of gear 56 mesh with teeth of an elongated rack 137. Rack 137 is secured to a slideway 138 supported by a pedestal 142. The rack 137 is constrained by gibs 139 to reciprocate in a slideway 138 in response to a driving force imparted to a "U" shaped drive bar 140. The driving force is imparted by a drive block 141 mounted in a slot formed in the underside of lower arm 105. Drive block 141 serves to convert oscillating motion of lower arm 105 to linear motion of the slide thereby reciprocating the rack 137 for rotation of a bottle through 360° for a decorating operation.

The present invention provides that ink decoration applied to a bottle at one of the decorating stations is cured by rotating the bottle at a curing station downstream in terms of workpiece flow in the decorating machine while the bottle dwells at the curing station in the course of advancing movement by the conveyor 12. The rotation of the bottle at the curing station exposes the applied ink in the area of the decoration for curing the ink before the bottle is discharged from the decorating station and preferably immediately after the ink decoration was applied. The rotation of the bottle at the curing station according to the preferred embodiment occurs concurrently with rotation of other bottles at the decorating stations and, when present, other curing stations.

Figure 10:
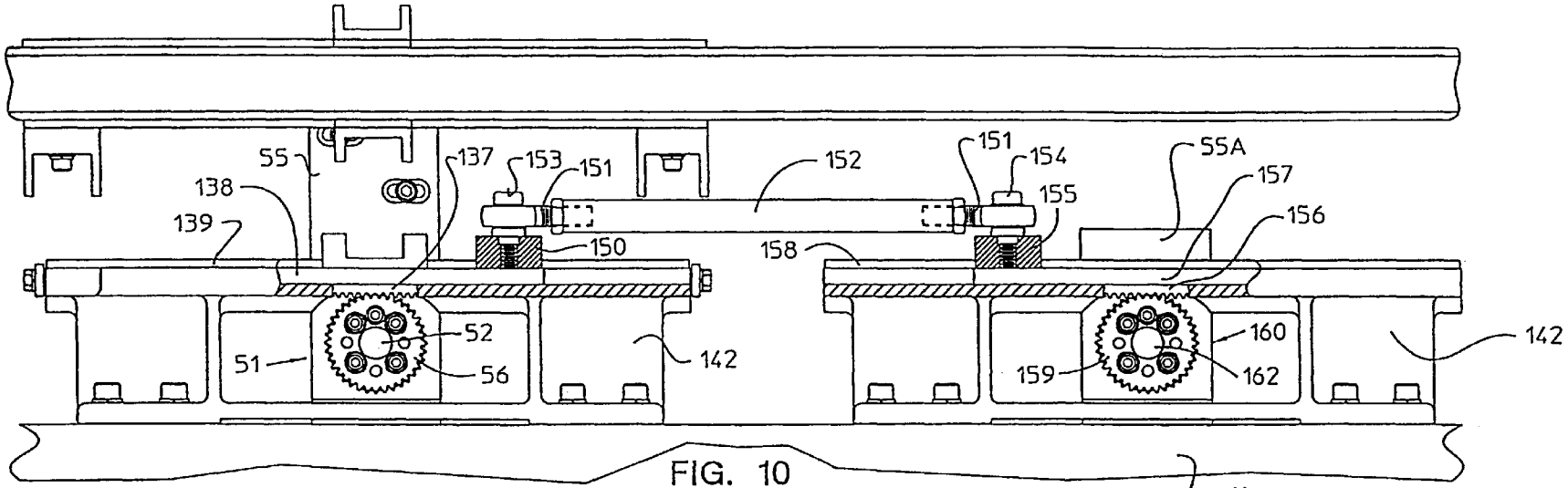
FIG. 10 is a sectional view taken along lines 10—10 of FIG. 7.
Figure 12:
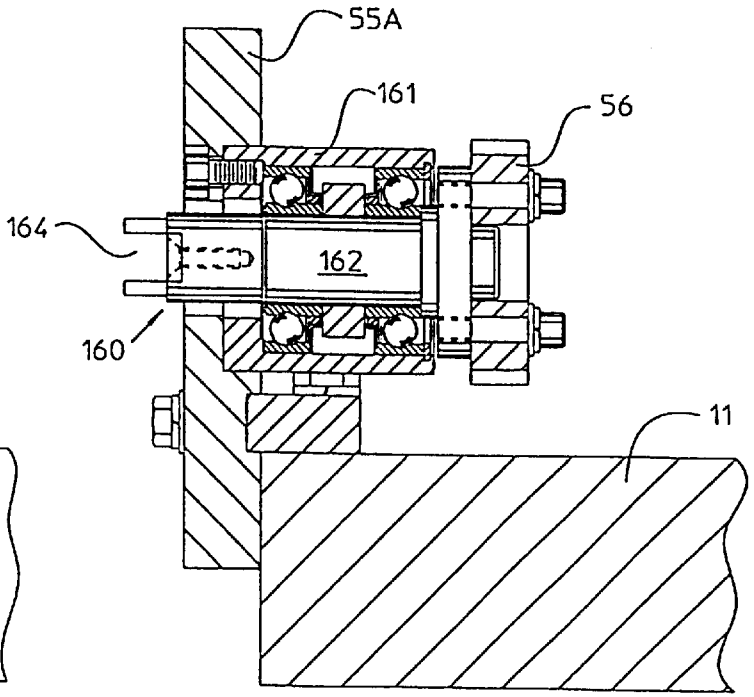
FIG. 12 is a sectional view taken along lines 12—12 of FIG. 11.
Figure 11:
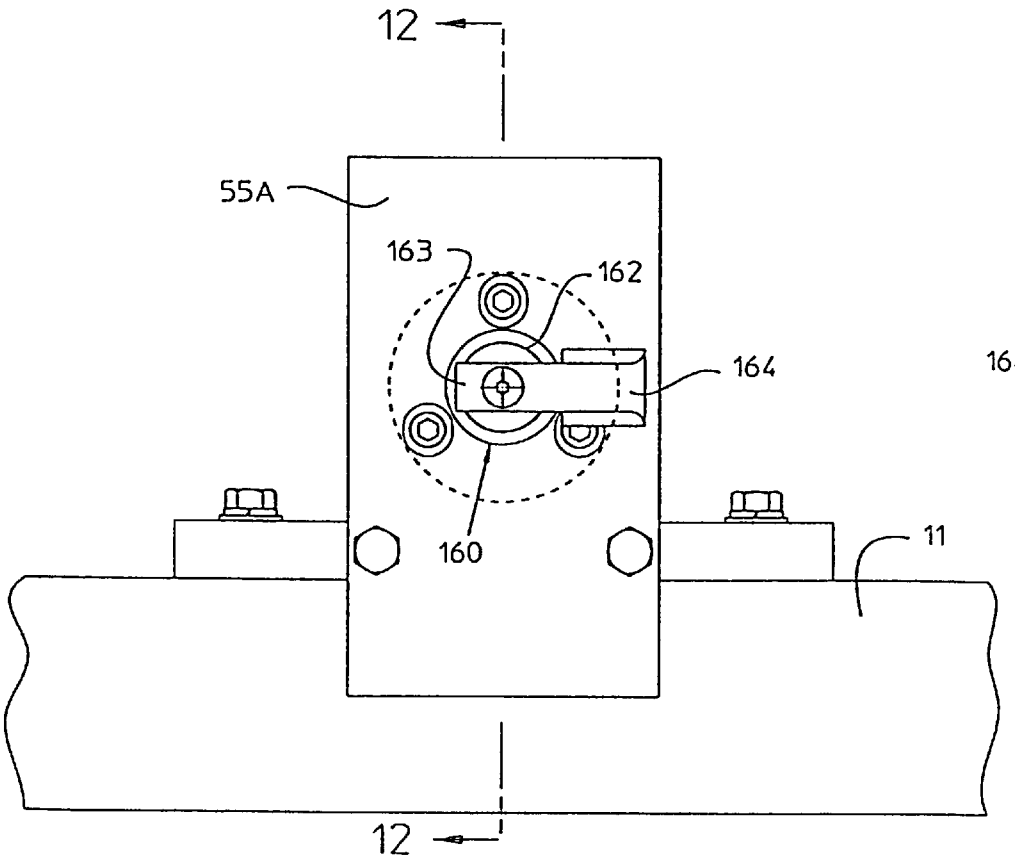
FIG. 11 is an enlarged front elevational view of a bottle rotator.

One suitable arrangement of parts for rotating a bottle at the decorating stations and at the curing stations is to utilize the mechanical motion used at a given decorating station to rotate a bottle to also rotate a different bottle at a curing station. As shown in FIG. 10 and described previously, the rack 137 is reciprocated to rotate drive gear 56 and thereby also arbor 52 of the rotator 51 (FIG. 7). A mounting block 150 is secured to the upper face surface which is opposite the gear teeth of the rack 137. A spherical rod end 151 at one end of a tie rod 152 is secured by a threaded fastener 153 to the mounting block 150. The opposite end of the tie rod 152 is provided with a spherical rod end 151 secured by threaded fastener 154 to a mounting block 155 which is secure to the upper surface of a rack 156. The rack 156 reciprocates on a slide 157 while restrained and guided by gib plates 158 mounted on the support pedestal 142. The gear teeth of rack 156 mesh with a drive gear 159 forming part of a curing rotator assembly 160. As shown in FIGS. 11 and 12, the rotator assembly includes a housing 161 wherein spaced apart bearings rotatably support an arbor 162. The housing 161 is secured to face plate 55A of the decorating machine at the site of a curing station. Mounted on an end of the arbor 162 protruding from the face plate is a rotator arm 163 provided with a slotted opening 164 and operates in the same manner as rotator assembly 51.

Figure 13:
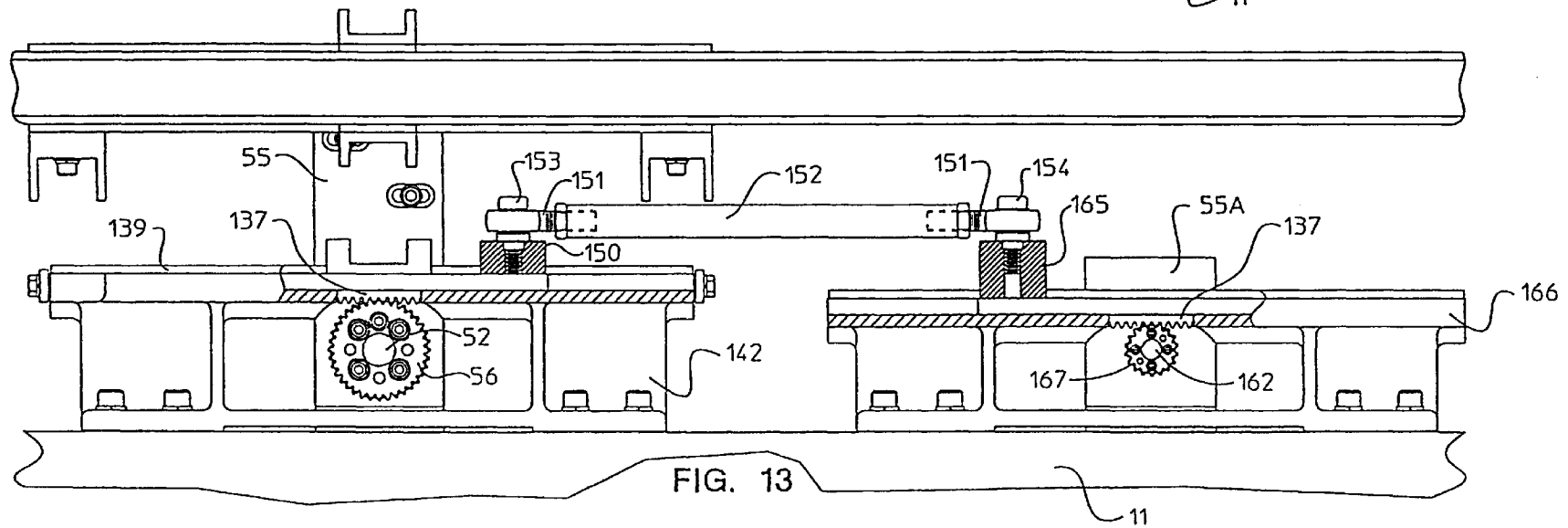
FIG. 13 is a view similar to FIG. 10 and illustrating a second embodiment of bottle rotating drive for a curing station.

There is a rotator 160 at each curing station C1, C2 and C3. As shown in FIG. 6, the roller 46 carried by the crank arm 45 for each bottle advanced by the conveyor is captured between rails 93 and 94. When the bottles approach a dwell period provided by the indexer drive 30 at each of the decorating stations and curing stations, the crank arms are controlled by the passage of the roller 46 from the space between rails 93 and 94 into the slotted openings 53 and 164 of the rotators at the decorating and curing stations, respectively. The reciprocating motion of each rack 137 imparts a corresponding, reciprocating motion to rack 156, at each curing station as a result of the mechanical interconnect formed by tie rod 152. At the conclusion of a dwell period, the bottles are again advanced by the conveyor whereby roller 46 meets crank arm or bottle at the decorating and curing stations passes from the respective slotted openings 53 and 164 and are again captured in the space between rails 93 and 94 as best shown in FIG. 6. Depending on the particular ink composition or other factors involved in the decoration process, it may be desirable to rotate a bottle at the curing stations more than one revolution during a dwell period. For this purpose and as shown in FIG. 13, the fastener 154 is used to secure spherical rod end 151 to a mounting block 165 which has an extended height sufficient to maintain tie rod 152 in a generally horizontal disposition as in the embodiment of FIG. 10. The extended height of block 165 compensates for the reduced height of pedestal 166 used to support rack 137 for reciprocal movement as in the embodiment of FIG. 10 however, in the embodiment of FIG. 13 a chive gear 167 has gear teeth defining a pitch diameter for a 2:1 or greater ratio such that the stroke of movement imparted to rack 137 producing one revolution of gear 56 will produce 2 or more revolutions of gear 167 and thereby rotate the bottle drivenly engaged with gear 167 more than one revolution. Partial revolutions, however, must be avoided since the associated crank arm 45 must be returned to the same position before rotation occurred to insure passage into the gap between the guide rails without the loss of registration between the decorative area of the bottle and the decorating screens at the decorating stations.

Figure 14:
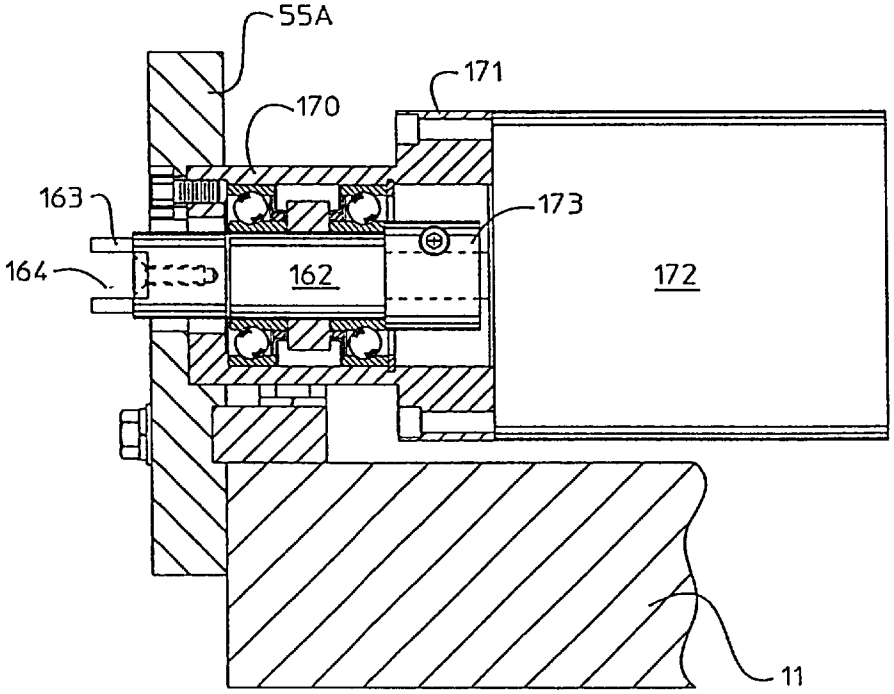
FIG. 14 is an illustration of a third embodiment of a rotating drive of a curing station.
Figure 15:
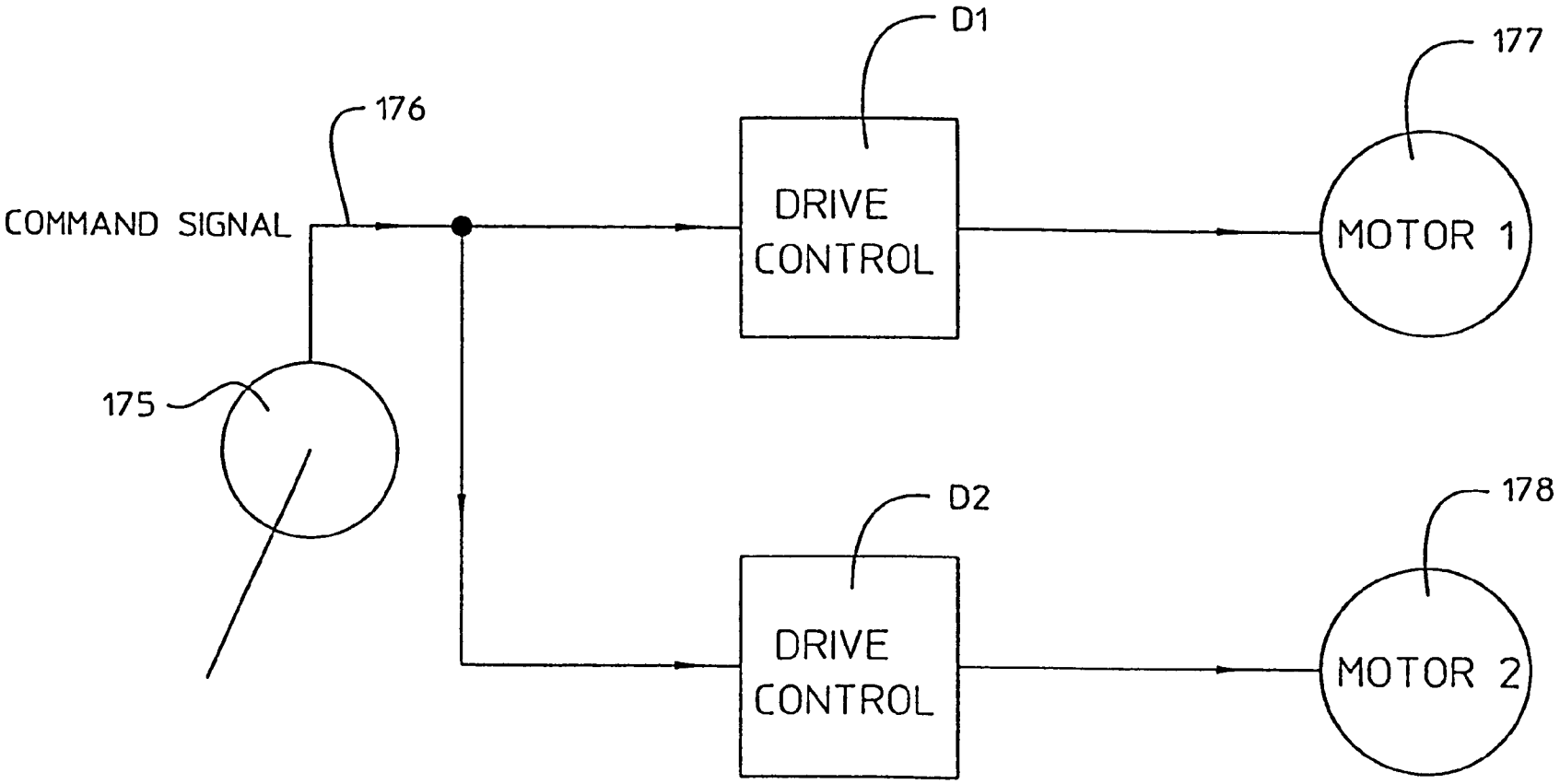
FIG. 15 is a schematic illustration of two bottle rotator drives responsive to a command signal.

In FIG. 14 there is illustrated a further embodiment of a drive to rotate a bottle at a curing station during a dwell period provided by the indexer drive for the bottle conveyor. In this embodiment, like the embodiment shown in FIG. 12, the arbor 162 is provided with the rotator arm 163 having slotted opening 164 for engaging the drive roller of a crank arm used to rotate a bottle at a curing station. The arbor is supported for rotation by spaced apart bearings in a housing 170 that is in turn secured by bolts to face plate 55A at one end of the housing. At the opposite end of the housing, there is an enlarged flange 171 to which is mounted a stepping motor 172 having a drive output shaft connected by a drive coupling 173 to arbor 162. The stepping motor 172 is controlled to rotate a bottle during a dwell period by a controller in response to a command signal derived from a drive cycle motion detector. The indicator will provide a command signal to the controller causing motor 172 to operate through one or more a complete revolutions within the time period formed by the dwell period. This drive arrangement can be utilized to rotate bottles during a dwell period at each curing station and at each decorating station. For this purpose as shown in FIG. 15, a motion detector 175 provides a command signal in line 176 which is applied to a drive control D1, D2 . . . DN, there being a drive control for each motor at the decorating stations and curing stations. In FIG. 15, drive control D1 controls a stepping motor 177 and drive control D2 controls a stepping motor 178. In this way the stepping motors 177 and 178 are controlled in a timed relation with the main drive motor 58 but the drive torque is not derived from the main drive motor.

Figure 16:
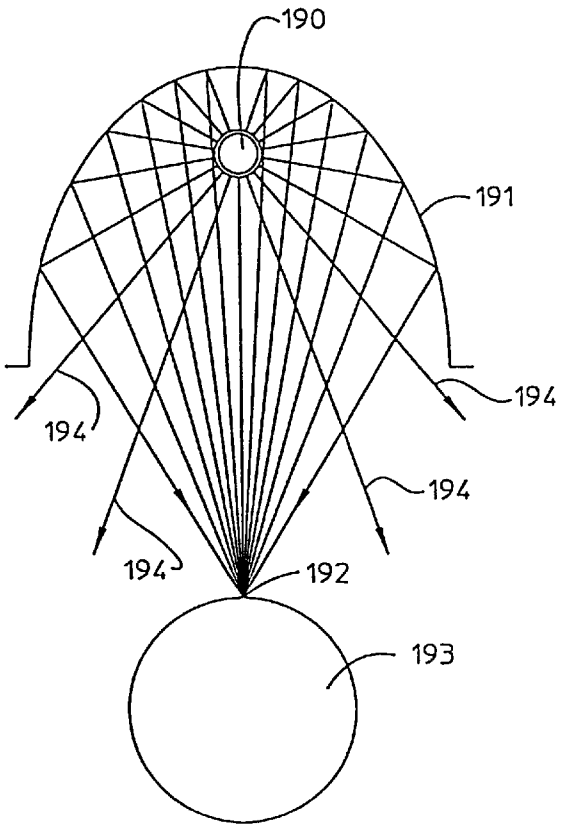
FIG. 16 is an enlarged sectional view illustrating an infrared radiator and collector to cure ink decoration on a bottle.

As shown in FIGS. 2, 6 and 7, at each curing station C1, C2 and C3, there is an open bottom housing 180 form by vertical side walls 181 and a top wall 182 forming an electromagnetic wave containment chamber 183. A bracket 184 includes a base 185 to which the housing 180 is secured and supported at the curing station. Slotted openings 186 in the upper portion of the bracket 184 receive fastener bolts for securing the bracket to a cross member 187 forming part of the decorating machine. In the lower portion of the housing 180 there is located an electromagnetic wave generator which according to the preferred embodiment of the present invention and as shown in FIG. 16 takes the form of a bulb 190 situated in a focal point of an elliptical reflector 191 used to focus ultra violet energy generated by the bulb into a narrow zone 192. Extended end sections of the reflector increase the collection of light at the surface of a bottle which is identified by reference numeral 193. Stray UV rays identified typically by reference numerals 194 if allowed to impinge with ink in a decorating screen will cause unwanted fusing the ultra violet curable ink in the screen. To protect the decorating screen from such stray UV rays there is provided a strip of flexible material 195 secured to and extending between a decorating screen assemblies 116 and 118 and the adjacent wall 181 of each open bottom housing 180, when ultra violet fusing occurs at opposite sides of a decorating. The strip of flexible material at 195 has a fold at 196 forming a line for flexure of the material as so that as the decorating screen reciprocates the material 191 folds and unfolds with the action of the bellows. The fasteners and slotted openings in the upper part of the bracket 184 are used to precisely locate the narrow zone 192 at the UV curing ink applied to the bottle 193.

Figure 19:
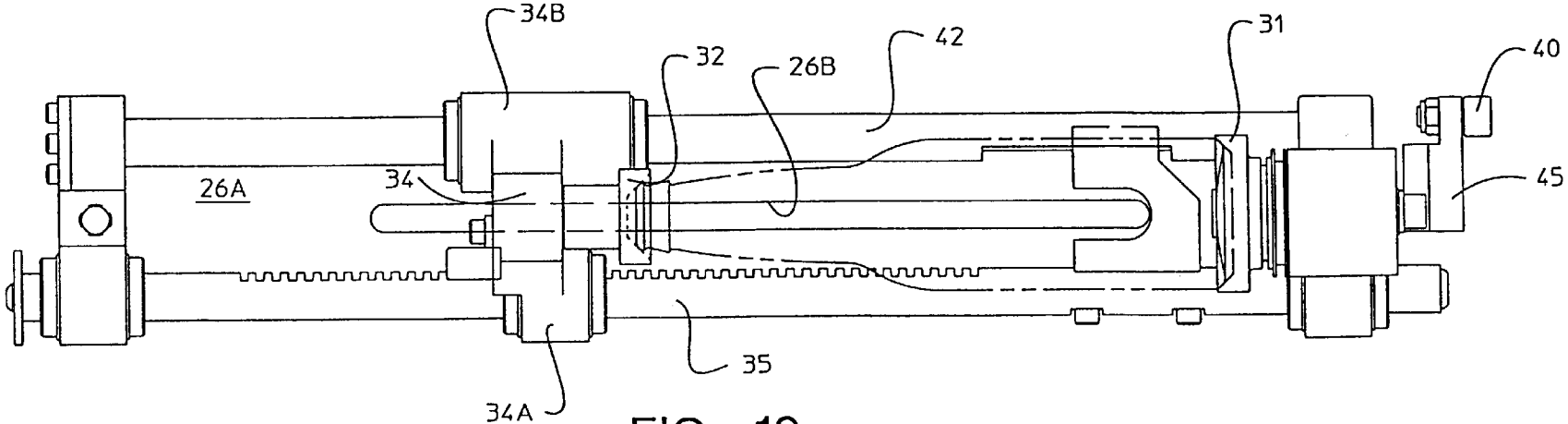
FIG. 19 is a plan view taken along lines 19—19 of FIG. 18.
Figure 17:
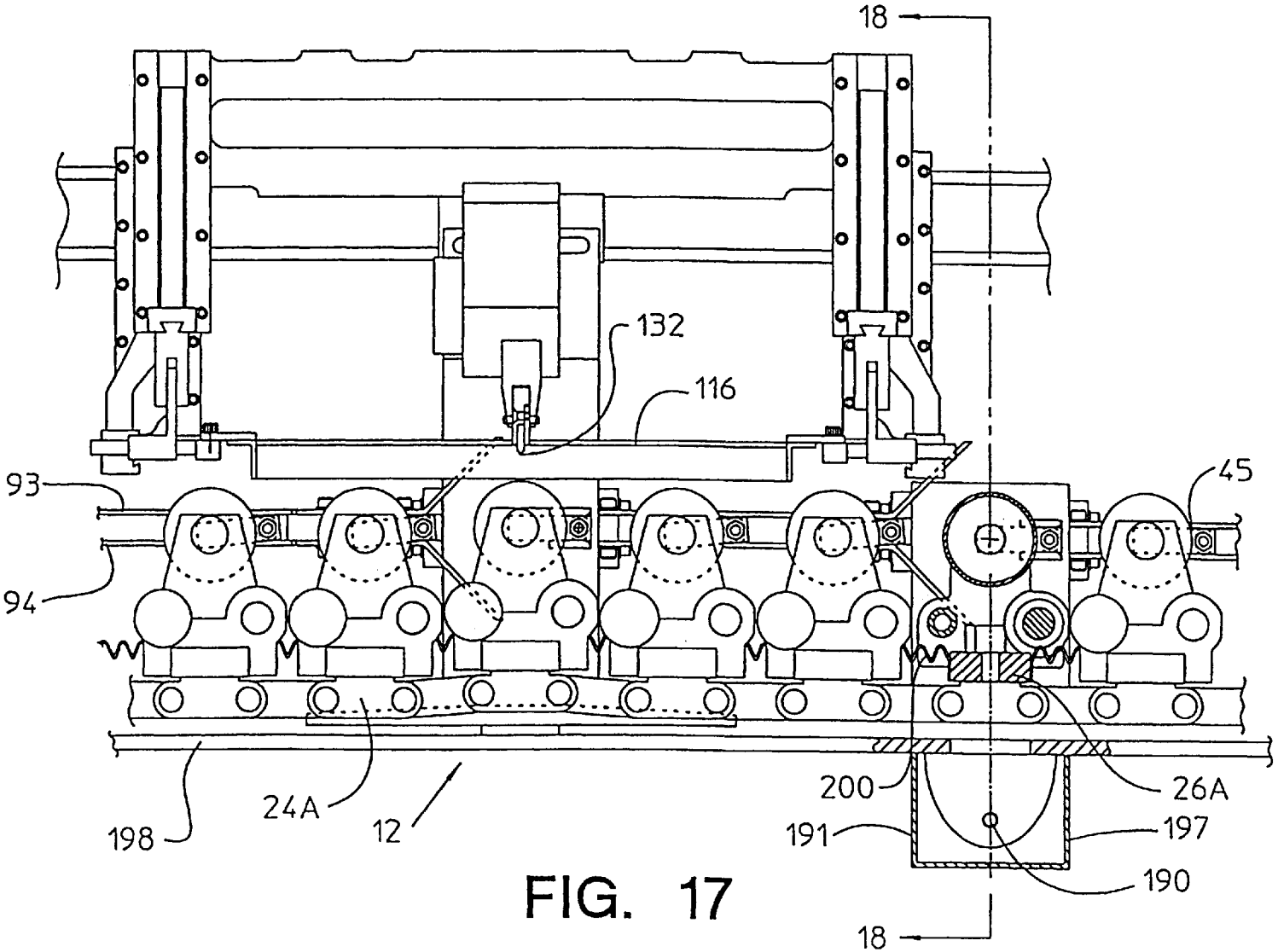
FIG. 17 is a view similar to FIG. 6 and illustrating a second embodiment of curing station.
Figure 18:
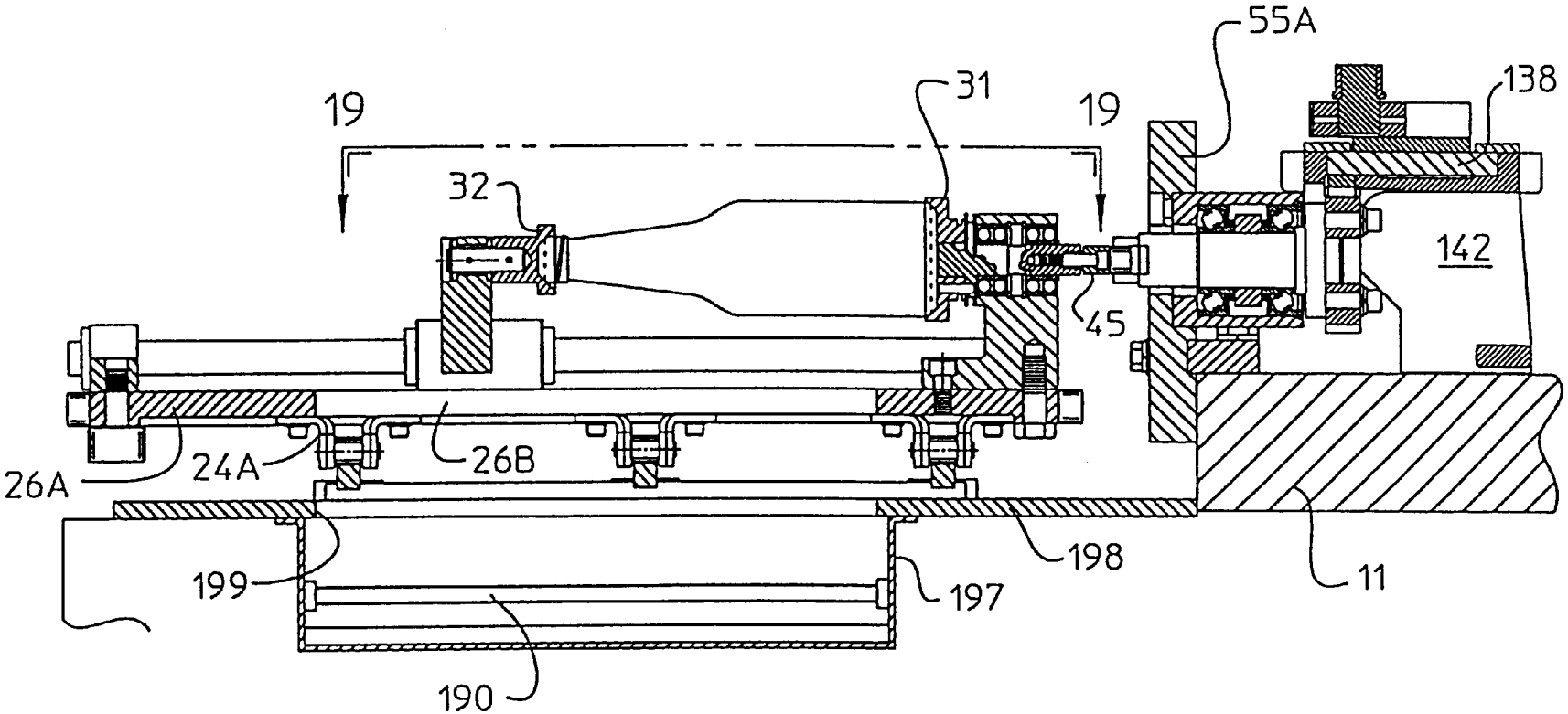
FIG. 18 is a sectional view taken along lines 18—18 of FIG. 17.

FIGS. 17 and 18 illustrate an embodiment of the present invention in which bulb 190 situated at the focal point of reflector 191 is contained with an open topped housing 197. The housing is secured to a support plate 198 for the endless chain conveyor 12. The housing 197 is located along the conveyor at the vertical plane of each curing station. As shown in FIGS. 17, 18 and 19, the carrier plate 26A of each chain link of 24A is provided with a slot 26B which is aligned with slot 199 when the link is in a dwell period at the curing station. As shown in FIG. 17, the gap between adjacent ones of the carrier plates 26A is spanned by strips of flexible material 200 which have multiple fold lines to provide bellows type function as the carrier plates proceed along the course of travel of the conveyor. It is to be understood that the bulb 190 can take the form of a quartz heating element in which event the reflector 191 is used to focus the sensible heat energy into a narrow zone at the surface of the workpiece to cure the ink decoration as the workpiece is rotated. Other forms of a generator for providing a source of electromagnetic waves to cure a specific ink composition can be used for the in line curing of decoration applied to workpieces by an interment motion decorating machine without departing from the present invention.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for decorating workpieces, said method including the steps of:

engaging opposite ends of successive ones of a plurality of workpieces for rotatable support about a longitudinal axis of each workpiece;

intermittently advancing each of said workpieces with respect to a decorating screen at each of a plurality of spaced apart decorating stations;

establishing a predetermined orientation of each workpiece by restraining each workpiece at and while advanced between the plurality of spaced apart decorating stations;

decorating workpieces at each of said spaced apart decorating stations by displacing an ink laden decorating screen along a path of travel between a squeegee and a workpiece;

advancing each workpiece after decorating at least at one of said decorating stations to at least a first curing station; and curing the ink decoration applied to a workpiece at the first curing station; said step of decorating workpieces and said step curing the ink decoration occurring while rotating the workpiece and maintaining said predetermined orientation.

2. The method according to claim 1 including the further steps of advancing a workpiece after decorating at another of said decorating stations to a second curing station; and curing the ink decoration applied to a workpiece at the second curing station, said step of decorating workpieces and said step curing the ink decoration occurring while rotating the workpieces and maintaining said predetermined orientation.

3. The method according to claim 1 wherein said plurality of spaced apart decorating stations include at least three decorating stations and wherein said step of advancing workpieces is further defined to comprise advancing a workpiece at each decorating station to an ink curing station and curing the ink applied to the workpiece while rotating the workpiece and maintaining said predetermined registration.

4. The method according to claim 1 further including the steps of arranging an energy radiator in a containment chamber having an emission opening proximate a workpiece residing at said first curing station.

5. The method according to claim 4 wherein said energy radiator comprises an infrared generator and wherein said step of curing the ink decoration includes focusing infrared radiation from said infrared generator to a zone of a workpiece while the workpiece rotates at said first curing station, and wherein said method further includes shielding said first curing station against emissions of stray radiation to avoid curing of ink at said decorating stations.

6. The method according to claim 1 wherein said step of curing the ink decoration includes focusing sensible heat energy in a beam to a zone of the workpiece while rotating the workpiece at said first curing station.

7. The method according to claim 1 wherein said predetermined orientation includes establishing a predetermined orientation of each workpiece with respect to said decoration screens, and wherein said method further includes the step of controlling rotation of a workpiece during advancement to and from said decoration stations and said curing station to retain use of said predetermined orientation.

8. The method according to claim 1 including the further step of using a drive for rotating workpieces at one of said first and second decorating stations to control a drive for rotating a workpiece at said first curing station.

9. The method according to claim 1 wherein said steps of decorating workpieces and curing the ink decoration includes generating a control signal in response to a dwell to said intermittent advancing of workpieces while workpieces reside at said decorating stations and at said curing station, and using said control signal to control drive motors to rotate workpieces during said dwell.

10. The method according to claim 1 wherein a workpiece at said curing station is rotated more than one revolution while concurrently a workpiece rotates one revolution at each decorating station.

11. Apparatus for decorating workpieces, said apparatus including the combination of:

a conveyor having successive workpiece support sites each including spaced apart chucks for supporting a workpiece, one of said spaced apart chucks including a drive arm to rotate a workpiece supported between the spaced apart chucks about a longitudinal axis of the workpiece;

a plurality of decorating stations arranged at spaced apart locations along said conveyor, said decorating stations each including a decorating screen to apply a curable printing medium while reciprocated between a squeegee and a workpiece at the printing station;

at least one curing station supported along said conveyor downstream of one of said decorating stations, said curing station including a generator for emitting a medium toward a workpiece to cure the applied printing medium thereon;

drive arm restraints between and at said decorating stations and said curing station for maintaining a predetermined orientation of each workpiece with respect to the decorating screens at said decorating stations while supported by said chucks;

a first drive coupled to said conveyor for intermittently advancing spaced apart workpieces along a course of travel containing said decorating stations and said ink curing station, said first drive being controlled to index each workpiece between a dwell period at each of the decorating stations and the ink curing station;

second drives to rotate workpieces while dwelling at said decorating stations; and a third drive to rotate a workpiece at the ink curing station in response to dwelling of a workpiece at said ink curing station.

12. The apparatus according to claim 11 wherein said second drive includes a decorating station driven gear to rotate one of said chucks while at a decorating station and said third drive includes a curing station driven gear to rotate one of said chucks while at said curing station, and wherein said apparatus further includes a torque transmitter for drivingly interconnecting said decorating station driven gear and said curing station driven gear.

13. The apparatus according to claim 12 wherein said curing station driven gear has a pitch diameter less than the pitch diameter of said decorating station driven gear to cause a workpiece at said curing station to rotate more than one revolution for each revolution by a workpiece at the decorating station.

14. The apparatus according to claim 12 wherein said torque transmitter includes a gear rack and guides to restrain said rack for reciprocal motion at each of said ink curing station and said one of said first and second decorating station.

15. The apparatus according to claim 14 further including a tie bar drivenly interconnecting said rack gear at each of said curing station and said decorating station.

16. The apparatus according to claim 11 wherein said plurality of decorating station includes at least three decorating stations and wherein said at least one curing station includes at least two curing stations.

17. The apparatus according to claim 11 wherein said generator for generating a medium comprises an infrared emitter and a reflector for focusing the infrared radiation at the workpiece at said curing station.

18. The apparatus according to claim 17 further including a housing for supporting said infrared emitter and reflector and an adjustable support for positioning said housing to focus inferred radiation on the workpiece.

19. The apparatus according to claim 18 further including a carrier having a cantilever arm for supporting said housing adjacent an upstream one of said decorating stations and an adjustable stop for selective positioning of said housing relative to a workpiece.

20. The apparatus according to claim 19 further including an infrared impervious bellows having an end supported by said housing and an opposite end supported by said decorating screen of said upstream one of said decorating stations to prevent curing of ink in the decorating screen thereof.

21. The apparatus according to claim 11 wherein one of said spaced apart chucks for each workpiece includes a drive arm and wherein said apparatus further includes an indexer to establish an application site defined by a predetermined orientation between each decorating screen and the drive arm of the chuck engaged with each workpiece, and wherein said restraint includes restraint rails extending between said decorating stations and said at least one curing station for receiving said drive arm for each workpiece to maintain said predetermined registration when a workpiece is moved between said decorating stations and said curing station.

22. The apparatus according to claim 21 further including a rotator driven by said first drive for rotating said drive arm and the workpiece drivenly engaged therewith.

23. In an apparatus for decorating successive workpieces while supported by a conveyor between spaced apart chucks and one of said chucks including a drive arm rotated by a workpiece drive about a longitudinal axis of the workpiece while a conveyor drive for the conveyor operates to cause workpieces to dwell at each of spaced apart first and second decorating stations where a curable printing medium in a decorating screen is applied to a workpiece while rotated by said drive and the decorating screen is reciprocated between a squeegee and a workpiece at each printing station, a predetermined orientation between the workpieces and the decorating screens is established before printing and maintained during printing at each printing station, the improvement comprising the combination of:

at least one curing station supported along said conveyor downstream of one of said first and second decorating stations, said curing station including a generator for supplying a curing medium to cure the printing medium applied to a workpiece at one of said first and second decorating stations to cause curing thereof while supported by said spaced apart chucks;

drive arm restraints between and at said decorating stations and said curing station to maintain said predetermined orientation; and a curing station drive controlled by said workpiece drive for rotating the workpiece while dwelling at said ink curing station.

24. In a method for decorating successive workpieces while supported by a conveyor between spaced apart chucks and rotated by a workpiece drive about a longitudinal axis of the workpiece while a conveyor drive for the conveyor operates to cause workpieces to dwell at each of spaced apart first and second decorating stations where a curable printing medium in a decorating screen is applied to a workpiece while rotated by said drive and the decorating screen is reciprocated between a squeegee and a workpiece at each printing station, a predetermined orientation between the workpieces and the decorating screens is established before printing and maintained during printing at each printing station, the improvement comprising, the steps of:

locating at least one curing station along said conveyor downstream of one of said first and second decorating stations, said curing station supplying a curing medium to cure the curable printing medium applied to a workpiece at one of said first and second decorating stations to cause curing thereof while supported by said spaced apart chucks;

maintaining said predetermined orientation at and between said curing station and said decorating stations; and rotating a workpiece at the curing station while applying the curing medium to the curable printing medium.

* * * * *